US007758309B2

(12) United States Patent
Bolms et al.

(10) Patent No.: US 7,758,309 B2
(45) Date of Patent: Jul. 20, 2010

(54) VANE WHEEL OF TURBINE COMPRISING A VANE AND AT LEAST ONE COOLING CHANNEL

(75) Inventors: Hans-Thomas Bolms, Mülheim an der Ruhr (DE); Andreas Heselhaus, Düsseldorf (DE); Roland Häbel, Bergisch Gladbach (DE); Torsten Koch, Oberhausen (DE); Ralf Müsgen, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 8 days.

(21) Appl. No.: 11/632,013

(22) PCT Filed: Jun. 13, 2005

(86) PCT No.: PCT/EP2005/052714

§ 371 (c)(1),
(2), (4) Date: Jan. 17, 2008

(87) PCT Pub. No.: WO2006/005659

PCT Pub. Date: Jan. 19, 2006

(65) Prior Publication Data

US 2008/0267784 A1 Oct. 30, 2008

(30) Foreign Application Priority Data

Jul. 9, 2004 (EP) ..... 04016237

(51) Int. Cl.
*F01D 5/18* (2006.01)

(52) U.S. Cl. ..... 416/96 R; 416/95; 416/193 A

(58) Field of Classification Search ..... 415/115–116; 416/95, 96 R, 96 A, 97 R, 193 A, 248
See application file for complete search history.

(56) References Cited

U.S. PATENT DOCUMENTS

| | | | | | |
|---|---|---|---|---|---|
| 3,800,864 | A * | 4/1974 | Hauser et al. | 165/47 |
| 4,712,979 | A * | 12/1987 | Finger | 416/96 R |
| 5,201,847 | A * | 4/1993 | Whidden | 415/177 |
| 5,252,026 | A | 10/1993 | Shepherd | |
| 5,531,568 | A | 7/1996 | Broadhead | |
| 6,158,962 | A * | 12/2000 | Lee et al. | 416/193 A |
| 6,830,427 | B2 * | 12/2004 | Lafarge et al. | 415/115 |
| 7,121,797 | B2 * | 10/2006 | Negulescu et al. | 416/97 R |
| 7,186,089 | B2 * | 3/2007 | Liang | 416/193 A |
| 2003/0143064 | A1 * | 7/2003 | Lafarge et al. | 415/115 |
| 2004/0081556 | A1 | 4/2004 | Chevrefils et al. | |

FOREIGN PATENT DOCUMENTS

| | | | | |
|---|---|---|---|---|
| DE | 103 55 449 | A1 | 6/2004 | |
| EP | 1 074 695 | A2 | 2/2001 | |
| FR | 2833035 | A1 * | 6/2003 | |
| JP | 64-63605 | A * | 3/1989 | 416/97 R |

* cited by examiner

*Primary Examiner*—Christopher Verdier

(57) ABSTRACT

There is described a vane wheel of a turbine comprising at least one vane, the footing thereof being held on a wheel disk. At least one cooling channel is arranged between the wheel disk and the vane footing. The vane wheel having a plurality of turbulators is embodied on at least one of the walls of the cooling channel, the turbulators being configured in such a way that the turbulence and thus the heat transfer of a cooling fluid flowing through the cooling channel are increased.

14 Claims, 2 Drawing Sheets

VANE WHEEL OF TURBINE COMPRISING A VANE AND AT LEAST ONE COOLING CHANNEL

CROSS REFERENCE TO RELATED APPLICATIONS

This application is the U.S. National Stage of International Application No. PCT/EP2005/052714, filed Jun. 13, 2005 and claims the benefit thereof. The International Application claims the benefits of European application No. 04016237.2 EP filed Jul. 9, 2004, all of the applications are incorporated by reference herein in their entirety.

FIELD OF INVENTION

The invention relates to a vane wheel of a turbine comprising a vane, the vane foot of which is held on a wheel disk, and in which at least one cooling channel is located between the wheel disk of the turbine and the vane foot. The invention relates, furthermore, to a vane of a vane wheel of this type.

BACKGROUND OF INVENTION

Vane wheels of the type initially mentioned are used, for example, in stationary gas turbines as moving vane wheels which are arranged downstream of a combustion chamber of the gas turbine in the direction of flow of fuel gas and are exposed to high temperatures there. The cooling of the vane leaves and, in particular, of the vane feet of such gas turbine vanes subjected to high temperature loads is particularly involved because of the complicated cooling fluid routing required for this purpose and the difficult sealing-off work, along with the high centrifugal force load. In turbine moving vanes, at the present time, convective cooling and other measures for reinforcing the heat transition between a cooling fluid flowing through cooling channels on the vane foot and the vane foot are adopted. Often, only a comparatively small quantity of cooling fluid is available, so that only a low heat flow can be discharged through a platform of the vane foot. The platform surface temperature can consequently be lowered only slightly.

For this purpose, US 2004/0081556 A1 discloses a gas turbine vane with a vane foot, a platform and a vane leaf. The platform extends from an inflow-side edge to an outflow-side edge with respect to the hot gas which flows through the gas turbine in the axial direction. The platform has an outflow-side edge which runs in the circumferential direction of the turbine disk and which projects beyond the axial width of the turbine disk in the manner of roof eaves. On the underside of the outflow-side edge of the platform are provided a plurality of structural elements influencing the cooling air flow. Guide ribs corotating rapidly with the rotor move over the more or less stationary cooling air and cause a flow deflection of the cooling air from the circumferential direction into the axial direction. Moreover, on the underside of the platform, both a turbulator-like local plinth field and ribs extending in the axial direction are provided. The plinth field and the ribs locally increase the heat transition from the outflow-side edge of the platform into the cooling air flowing past on the underside.

SUMMARY OF INVENTION

An object on which the invention is based is to provide a vane wheel for a turbine comprising a vane, at the vane foot or vane platform of which reinforced cooling can be achieved and a comparatively high heat flow can be discharged. Furthermore, the object of the invention is to specify a production method for such a vane. This first-mentioned object is achieved, according to the invention, in that, on at least one of the walls of the cooling channel of a vane wheel according to the invention, a multiplicity of turbulators are formed, which are configured in such a way that they increase the turbulence of a cooling fluid flowing through the cooling channel.

In comparison with known cooling configurations on vane feet or vane platforms of turbine moving vanes, according to the invention, in the at least one cooling channel extending axially or in the main flow direction of a hot gas between the outer circumference of the wheel disk and the underside of the platform of the vane, the cooling fluid does not flow along more or less smooth walls, but, instead, a multiplicity of turbulators or turbulence elements are provided purposefully, which are formed on at least one of the walls of the cooling channel and increase the turbulence of the cooling fluid within the cooling channel. By means of these turbulators, the heat transition between the swirled cooling fluid and all the walls, but, in particular, that wall of the cooling channel which is associated with the turbulators, is increased, and the vane foot is thereby cooled in a reinforced way. The turbulators or turbulence elements are adapted correspondingly to the desired heat transition, so that a maximum material temperature on the hot-gas side can be predetermined on the associated vane in a controlled way and the cooling fluid stream through the cooling channel can be dimensioned correspondingly.

Ribs or nipples or dimples may be used as turbulators.

In an advantageous development of the vane wheel according to the invention, the multiplicity of turbulators are advantageously formed on the underside of a platform of the vane foot. By the use of turbulators or turbulence elements on the platform underside, which increase the turbulence in the gap between the vane foot and the disk head of the wheel disk, the heat flow in the platform wall is increased and the platform surface temperature is lowered.

The multiplicity of turbulators are advantageously configured in the form of pockets which are shaped in the material forming the at least one wall of the cooling channel. Such pockets may even be formed at a later stage in already existing vanes, and, consequently, the desired increase according to the invention in the heat transition at the vane foot can be achieved.

Furthermore, the turbulators or pockets are advantageously oriented in each case essentially transversely or obliquely with respect to the flow direction of the cooling fluid flowing through the cooling channel. Turbulators of this type lead to a particularly high swirling of cooling fluid flowing in the cooling channel. A particularly good and uniform cooling of the platform can be achieved if the turbulators are oriented obliquely with respect to the flow direction of the cooling fluid flowing through the cooling channel, in such a way that they at least partially deflect the flowing cooling fluid in the direction of a neck of the vane foot. The throughflow of the cooling channel, which is mostly of wedge-shaped or triangular cross section, can consequently be adapted in a controlled way.

So that the reinforced cooling according to the invention can be utilized on regions of the vane wheel with increased heat load which are particularly to be cooled, in such regions of increased heat load the number of turbulators or pockets provided per unit area should be increased, as compared with regions of lower heat load.

Furthermore, in the vane wheel according to the invention, the vane foot of at least one vane should advantageously be configured with a platform, on which a cooling channel is located on each of the two sides along an elongated neck of the vane foot, and the multiplicity of turbulators should be configured in the form of a row extending in the associated cooling channel on the underside of the platform. By means of such turbulators on the underside of the platform, vanes of vane wheels according to the invention can be made capable of use at higher temperatures without major structural modification.

The turbulators according to the invention can be shaped together in one operation forming the vane and, in particular, its vane leaf, so that there is virtually no additional outlay for the production of these turbulators.

Alternatively or additionally, the turbulators may be shaped in a separate operation after at least one operation forming the vane and, in particular, its vane leaf. By means of this procedure, in particular, vane wheels of existing turbines can be retrofitted in the inventive way with turbulators or pockets which lead to the above-explained improved heat transition at the vane foot.

The object of the invention is achieved, furthermore, by means of a vane for a vane wheel of a turbine, in particular a gas turbine, which is provided with a vane leaf around which a hot gas can flow and with a vane foot having a platform which, with respect to the main flow direction of the hot gas, extends from an inflow-side edge to an outflow-side edge along a longitudinal platform edge, and in which, on the underside, facing away from the vane leaf, of the platform, along the longitudinal platform edge, a multiplicity of turbulators are formed, which are configured in such a way that, in the built-in state of the vane, they increase the turbulence of a cooling fluid flowing along the underside.

As explained above, on such a vane according to the invention, improved heat discharge and cooling are achieved in the region of the associated vane foot, thus resulting, virtually without any cost outlay, in an increased sale value of the machines.

As likewise already mentioned, the multiplicity of turbulators on a vane of this type should be configured in the form of pockets which are shaped in the material of the platform.

To achieve the object aimed at the method, the turbulators are shaped in together in one operation forming the vane leaf. The turbulators are thus coformed directly during the new production of the vane.

Alternatively, an already existing vane which is being used can be retrofitted with the turbulators during an inspection interval of the gas turbine, in that these are shaped in a separate operation after at least one operation forming the vane leaf. As a result, the useful life of the vane can be further increased, while at the same time cooling air is saved, this, furthermore, having a positive effect on the efficiency of the gas turbine.

BRIEF DESCRIPTION OF THE DRAWINGS

An exemplary embodiment of a vane wheel according to the invention is explained in more detail below with reference to the accompanying diagrammatic drawings in which.

DETAILED DESCRIPTION OF INVENTION

Figure 1:
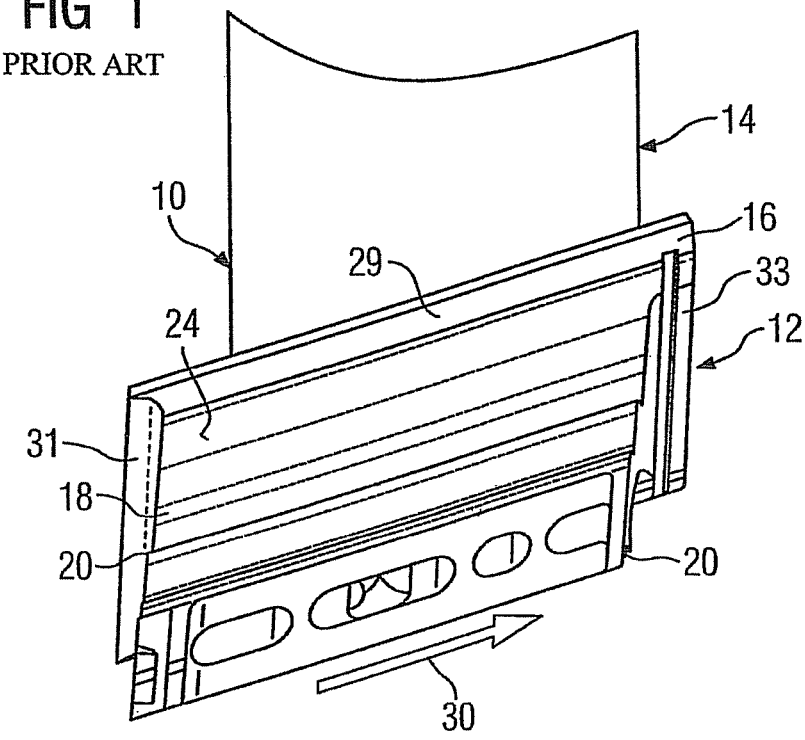
FIG 1 PRIOR ART
FIG. 1 shows a perspective view of a vane foot of a vane of a turbine according to the prior art.

FIG. 1 illustrates a vane 10 according to the prior art which has a vane foot 12 and a vane leaf 14 adjoining the latter. The vane foot 12 is configured as a pinetree foot with a platform 16, on which a neck 18 is arranged on the side lying opposite the vane leaf 14 and, further away, teeth 20 are arranged. The platform 16, the neck 18 and the teeth 20 are configured as an elongate profile which, with the vane 10 built in, is arranged in a groove, not illustrated, of a wheel disk 22 of the turbine rotor and is provided there for holding the vane leaf 14 and for the absorption of, in particular, centrifugal forces of the latter.

Figure 3:
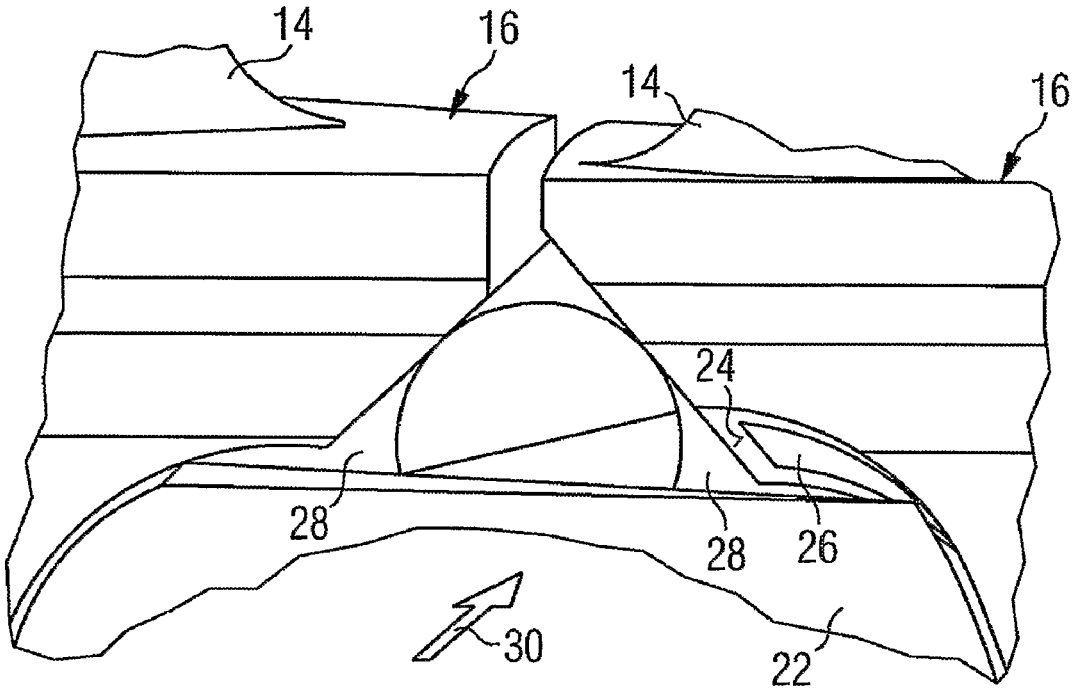
FIG. 3 shows a perspective view of the built-in situation of a vane foot according to FIG. 2.

Such a built-in position of a vane 10 on a wheel disk 22 is basically illustrated in FIG. 3.

As can be seen in FIG. 1, in the known vane 10, the underside, facing the neck 18 and the teeth 20, of the platform 16 is provided with an essentially smooth surface.

Figure 2:
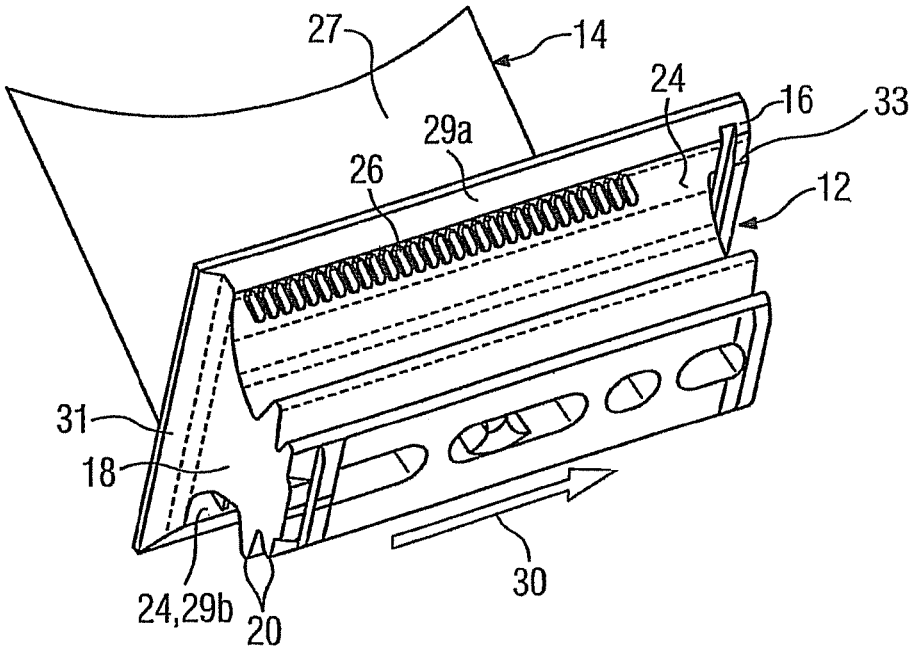
FIG. 2 shows a perspective view of a vane foot of a vane according to the invention of a turbine.

In the case of a vane 10, illustrated in FIG. 2, which is configured basically in the same way as the example according to FIG. 1 in terms of the vane foot 12, by contrast, the underside 24 is configured with a multiplicity of turbulators 26 which may in each case be arranged in a row on both sides of the neck 18.

The turbulators 26 face a cooling channel 28 which extends in the main flow direction of a hot gas and which is provided between the underside 24 of the platform 16 and the outer circumference of the wheel disk 22.

The cooling channel 28 runs along a longitudinal platform edge 29 which extends from an inflow-side edge 31 of the platform 16 to an outflow-side edge 33 with respect to the main flow direction of the hot gas flowing through the gas turbine during operation.

When the associated gas turbine is in operation, a cooling fluid, not illustrated, flows in a flow direction 30 through the cooling channel 28. The turbulators 26 are arranged only along the longitudinal platform edge 29 and with regard to this flow of the cooling fluid are configured transversely or obliquely with respect to the flow direction 30 as pockets which are shaped in the material of the platform 16 and which in each case have an opening to the underside 24 of the latter. In these pockets, an additional swirling of the cooling fluid flowing through the cooling channel 28 occurs, and, consequently, an improved heat transition from the platform 16 into the cooling fluid. The pockets thus lead to an increased heat discharge and an improved cooling of the vane foot 12 and the platform 16.

The vane leaf 14 has a pressure-side wall 27.

Particularly in the case of platforms 16 of asymmetric size of a turbine vane 10, the design with turbulators 26 arranged on the underside affords advantages. If one of the two longitudinal platform edges 29, for example the pressure-side platform side 29*a* with respect to the vane leaf 14, projects further out in the circumferential direction of the wheel disk 22 than the other of the two longitudinal platform edges 29, that is to say the suction-side platform side 29*b* for the example, it is sufficient, as shown in FIG. 3, to provide only on the underside 24 of the pressure-side longitudinal platform edge 29 turbulators 26 which swirl the cooling fluid in the cooling channel 28 and thus also make possible a heat transition which is increased sufficiently, as compared with the prior art, also for the suction-side longitudinal platform edge 29*b* of the directly adjacent turbine vane 10 of the vane wheel.

The pockets of the turbulators 26 may, for example, be eroded into the material of the platform 16 and in this case advantageously have a length which corresponds to about twice to seven times, in particular three to five times, particularly advantageously, four times the width of a pocket. Alternatively to pockets, the turbulators 26 may also be designed in the form of nipples or dimples on the underside 24 of the platform 16. By means of such turbulators 26, in each case slots or webs are configured on the underside 24, which constitute partial flow resistances for the cooling fluid flowing through the cooling channel 28 and consequently lead to turbulences within the cooling fluid.

Moreover, the turbulators 26 are preferably oriented obliquely with respect to the cooling fluid flow in such a way that they guide the cooling fluid away from a gap 37 which is formed by two platforms 16, lying opposite one another on the end face, of adjacent turbine vanes 10. The cooling fluid is thus also routed toward the neck 18 of the vane foot 12 by the turbulators 26. As shown in FIG. 3, the cross section 39, present below the platform 16, of the cooling channel 28 is wedge-shaped, that is to say the radial height of the cross section 39 decreases from the platform edge toward the neck 18 of the vane foot 12. Without turbulators 26 set obliquely in this way, because of the locally lower flow resistance the cooling fluid would flow to an increased extent in the larger cross-sectional region 41 than in the smaller cross-sectional region 43 near the neck. By means of turbulators 26 set obliquely in this way, this effect is suppressed effectively and the cooling fluid is routed to an increased extent into the smaller cross-sectional region 41 toward the neck 18 of the vane foot 18, thus leading to an equalization of the cooling of the platform 16. By means of the turbulators 26 set obliquely preferably at an angle of 45° with respect to the flow direction 30, a spiral cooling fluid stream along the cooling channel 28 can be brought about, which rotates directly below the underside 24 of the platform 16 toward the neck 18 of the vane foot 12.

Instead of pockets eroded in on the underside 24 of the platform 16, additional material may be applied to the underside 24 of the platform 16 for the turbulators 26 by build-up welding. This additional material is then at least partially removed by suitable methods in a subsequent work step in order thereby to form the turbulators 26.

Alternatively to the production methods presented, a prefabricated separate module with turbulators 26 may also be fastened cost-effectively by positive and/or nonpositive connection in an operation separate from the (casting) production of the turbine vane. Prefabricated modules can be mounted at a later stage in a time-saving way during inspection work.

The turbulator module may have, for example, the same longitudinal extent as the longitudinal platform edge 29 and, equipped with a tongue and groove configuration, may be capable of being pushed on the end face into the platform 16 into a corresponding recess extending along the underside 24, in order subsequently to be fixed by welding or soldering.

The invention claimed is:

1. A vane wheel for a turbine, comprising:

a vane having a vane foot with a platform held on a wheel disk;

a cooling channel having walls located between an outer circumference of the wheel disk and the platform, the cooling channel extending in and configured to convey a cooling fluid in a main flow direction of a hot gas which flows around the vane;

at least one wall having a plurality of turbulators wherein the plurality of turbulators increase the turbulence of a cooling fluid flowing through the cooling channel and deflect the flowing cooling fluid in the direction of a neck of the vane foot of the vane on which the turbulators are disposed.

2. The vane wheel as claimed in claim 1, wherein the plurality of turbulators are formed on an underside of the platform of the vane foot.

3. The vane wheel as claimed in claim 1, wherein the plurality of turbulators form pockets which are shaped in the at least one wall of the cooling channel.

4. The vane wheel as claimed in claim 1, wherein the turbulators are oriented substantially transversely with respect to the flow direction of the cooling fluid flowing through the cooling channel.

5. The vane wheel as claimed in claim 1, wherein the turbulators are oriented substantially obliquely with respect to the flow direction of the cooling fluid flowing through the cooling channel.

6. The vane wheel as claimed in claim 1, wherein the turbulators are oriented obliquely with respect to the flow direction of the cooling fluid flowing through the cooling channel, so that they impart a rotation to the flowing cooling fluid in the direction of the neck of the vane foot of the vane on which the turbulators are disposed.

7. The vane wheel as claimed in claim 1, wherein the vane foot is configured with the platform, a cooling channel located on each of two sides along an elongated neck of the platform, and the plurality of turbulators are configured in a row extending in the associated cooling channel on the underside of the platform.

8. The vane wheel as claimed in claim 1, wherein the turbulators are shaped together in one operation forming the vane and a vane leaf.

9. The vane wheel as claimed in claim 1, wherein the turbulators have been shaped in a separate operation after at least one operation forming the vane and a vane leaf.

10. A vane for a vane wheel of a turbine, comprising:

a vane leaf with a vane foot having a platform which, with respect to a main flow direction of hot gas, extends from an inflow-side edge to an outflow-side edge along a longitudinal platform edge, the vane foot and longitudinal platform edge defining a portion of a cooling channel that conveys a cooling fluid from the inflow-side edge to the outflow-side edge; and a plurality of turbulators on an underside of the platform facing away from the vane leaf along the longitudinal platform edge, the turbulators effective to increase the turbulence of a cooling fluid flowing along the underside and deflect the flowing cooling fluid toward a neck of the vane foot of the vane on which the turbulators are disposed.

11. The vane as claimed in claim 10, wherein the turbine is a gas turbine.

12. The vane as claimed in claim 10, wherein the turbulators form pockets shaped in the shape of the platform.

13. The vane as claimed in claim 10, wherein the turbulators are oriented obliquely with respect to the flow direction of the cooling fluid flowing along the longitudinal platform edge, so that the turbulators impart rotation to the flowing cooling fluid in the direction of the neck of the vane foot.

14. A vane wheel for a turbine, comprising:

a vane having a vane foot with a platform held on a wheel disk;

a cooling channel having walls located between an outer circumference of the wheel disk and the platform, the cooling channel extending in and configured to convey a cooling fluid in a main flow direction of a hot gas which flows around the vane, wherein all cooling fluid that enters the cooling channel is conveyed out a cooling channel downstream end except for cooling fluid that escapes from the cooling channel via a gap between adjacent vanes;

at least one wall having a plurality of turbulators wherein the plurality of turbulators increase the turbulence of a cooling fluid flowing through the cooling channel and deflect the flowing cooling fluid in the direction of a neck of the vane foot of the vane on which the turbulators are disposed.

* * * * *